US008985273B2

(12) United States Patent
Terry

(10) Patent No.: US 8,985,273 B2
(45) Date of Patent: Mar. 24, 2015

(54) PORTABLE WINDOW WASHER ANCHORING AND TETHERING APPARATUS

(76) Inventor: Kevin Terry, Miami, FL (US)

( * ) Notice: Subject to any disclaimer, the term of this patent is extended or adjusted under 35 U.S.C. 154(b) by 141 days.

(21) Appl. No.: 13/617,937

(22) Filed: Sep. 14, 2012

(65) Prior Publication Data

US 2014/0076659 A1 Mar. 20, 2014

(51) Int. Cl.

| | |
|---|---|
| ***A47L 3/00*** | (2006.01) |
| ***A47L 3/02*** | (2006.01) |
| ***E04G 21/32*** | (2006.01) |

(52) U.S. Cl.

CPC ... *A47L 3/00* (2013.01); *A47L 3/02* (2013.01); *E04G 21/3276* (2013.01); *E04G 21/3238* (2013.01)

USPC ..... 182/4; 182/3; 182/45; 182/150

(58) Field of Classification Search

USPC ..... 182/3, 4, 39, 62.5, 129, 137, 150, 141, 182/142, 145, 13, 45

See application file for complete search history.

(56) References Cited

U.S. PATENT DOCUMENTS

| | | | | | |
|---|---|---|---|---|---|
| 842,331 | A | * | 1/1907 | Palmer | 182/13 |
| 1,663,279 | A | * | 3/1928 | Portt | 182/62 |
| 2,315,668 | A | * | 4/1943 | Swango | 182/61 |
| 2,392,584 | A | * | 1/1946 | Falkenstein | 182/16 |
| 2,598,730 | A | * | 6/1952 | Thompson et al. | 182/2.6 |
| 3,456,756 | A | * | 7/1969 | Price | 182/2.6 |
| 3,576,233 | A | * | 4/1971 | Thatcher | 182/69.6 |
| 3,608,670 | A | * | 9/1971 | Blake et al. | 182/2.6 |
| 3,937,301 | A | * | 2/1976 | Bertail | 187/243 |
| 4,074,790 | A | * | 2/1978 | Colbachini et al. | 182/2.6 |
| 4,125,173 | A | * | 11/1978 | Rust et al. | 182/69.6 |
| 4,194,591 | A | * | 3/1980 | Fisher | 182/17 |
| 4,234,055 | A | * | 11/1980 | Beeche | 182/142 |
| 4,397,373 | A | * | 8/1983 | Ream et al. | 182/17 |
| 4,496,027 | A | * | 1/1985 | Fisher | 182/142 |
| 4,597,498 | A | * | 7/1986 | Spinosa et al. | 212/303 |
| 4,614,251 | A | * | 9/1986 | Hawkins | 182/69.5 |
| 4,801,117 | A | * | 1/1989 | Take | 248/237 |
| 4,817,758 | A | * | 4/1989 | Gilmore | 182/16 |
| 5,065,838 | A | * | 11/1991 | Finley | 182/38 |
| 5,135,078 | A | * | 8/1992 | Bell et al. | 182/142 |
| RE34,404 | E | * | 10/1993 | Dupont et al. | 182/146 |

(Continued)

OTHER PUBLICATIONS definition of 'arm' provided in Action Collins English Dictionary—Complete and Unabridged © HarperCollins Publishers 1991, 1994, 1998, 2000, 2003.*

*Primary Examiner* — Daniel Cahn

(74) *Attorney, Agent, or Firm* — Allen, Dyer, Doppelt Milbrath & Gilchrist

(57) ABSTRACT

A portable folding support structure for safely tethering an individual comprises a portable cart sized to fit through a residential doorway, having wheels and a motor that actuates at least one of the wheels. A hand-operated throttle and steering device control the cart. The cart comprises an extendable anchoring plate to prevent rolling. A substantially horizontal jib with the cart comprises a harness point for receiving a safety cable to which an individual is attached to allow safe cleaning practices and to minimize fall risk. A foldable outrigger provides stability to the cart and an anchoring pad attaches to a distal region of the outrigger to promote stability. A textile liquid-absorbing surface is positionable about an outer surface of a glass balcony to inhibit cleaning liquids from spilling below the level of the liquid-absorbing surface.

5 Claims, 5 Drawing Sheets

(56) References Cited

U.S. PATENT DOCUMENTS

| | | | | | |
|---|---|---|---|---|---|
| 5,271,482 | A * | 12/1993 | Walz | 182/69.6 |
| 5,297,652 | A * | 3/1994 | Armond et al. | 182/63.1 |
| 5,690,240 | A * | 11/1997 | Thiermann, Sr. | 212/180 |
| 5,934,437 | A * | 8/1999 | Anson et al. | 193/15 |
| 6,039,194 | A * | 3/2000 | Beeche et al. | 212/301 |
| 6,217,044 | B1 * | 4/2001 | Beeche et al. | 280/43 |
| 6,227,553 | B1 * | 5/2001 | Palmer | 280/47.18 |
| 6,889,798 | B2 * | 5/2005 | Overby et al. | 182/142 |
| 7,032,710 | B2 * | 4/2006 | Anderson et al. | 182/16 |
| 8,100,228 | B2 * | 1/2012 | Hamilton et al. | 182/142 |
| 8,240,431 | B2 * | 8/2012 | Smith | 182/3 |
| 8,556,034 | B2 * | 10/2013 | Rice | 182/129 |
| 8,584,798 | B2 * | 11/2013 | Stoffels et al. | 182/3 |
| 8,584,802 | B2 * | 11/2013 | Earl et al. | 182/127 |
| 2005/0034920 | A1 * | 2/2005 | Anderson | 182/3 |
| 2005/0169735 | A1 * | 8/2005 | Pelsue | 414/469 |
| 2009/0321184 | A1 * | 12/2009 | Hamilton | 182/3 |
| 2011/0303484 | A1 * | 12/2011 | Stoffels et al. | 182/3 |
| 2012/0125716 | A1 * | 5/2012 | Love et al. | 182/222 |
| 2013/0264442 | A1 * | 10/2013 | Correia | 248/205.1 |

* cited by examiner

PORTABLE WINDOW WASHER ANCHORING AND TETHERING APPARATUS

FIELD OF THE INVENTION

The present invention generally relates to safety equipment, and more particularly to a tethering and anchoring apparatus to secure workers when working near the edge of a balcony.

BACKGROUND

High-rise apartment buildings often have balconies surrounded by glass barriers. Though a building may employ rooftop-anchored window washers to clean such exterior glass, such a service is costly, and typically only occurs a few times a year.

If an individual tenant wishes to clean the glass surrounding their own balcony at any other time, it is typically their own responsibility to do so. It would generally be too costly to hire a roof-top-anchored window washer to wash the glass for a single unit, so contractors or tenants typically just lean over the edge of the balcony to clean the glass manually, which poses a severe fall risk.

Besides being dangerous or fatal, leaning over to wash the glass of a single unit also typically results in significant amounts of dirty or soapy water soiling the glass of balconies situated below the balcony being washed. Although conventional roof-top-anchored window washing is effective, it is not always practical or cost efficient for single-unit needs, and improvement is needed.

SUMMARY

This and other objects, features, and advantages in accordance with the present invention are provided by a portable folding support structure for safely tethering an individual. In one embodiment, a portable cart has wheels and a motor that actuates at least one of the wheels. The cart is of a size and dimension to fit through a residential doorway when in a folded state. A hand-operated throttle controls the motor, while a hand-operated steering device is used to control the direction of cart travel.

An anchoring plate is extendable from the cart to contact a surface below the cart to lift the cart to prevent the cart from unwanted rolling. A substantially horizontal jib with the cart has a harness point capable of receiving a safety cable to which a worker may be attached.

A first foldable outrigger projecting from the cart provides additional stability to the cart when the outrigger is in the unfolded position. An anchoring pad attached to a distal region of the first foldable outrigger also promotes stability of the cart.

In a related embodiment, a first extension arm is connected to the first foldable outrigger. The first extension arm has an ascending portion and a substantially vertical descending portion.

Additionally, a second foldable outrigger projects from the cart to provide stability to the cart, and a second extension arm is connected to the second foldable outrigger. The second extension arm also has an ascending portion and a substantially vertical descending portion.

A textile, liquid-absorbing, surface has a first end, a second end, an inner edge and an outer edge. The first end is attached proximate the descending portion of the first extension arm and the second end is attached proximate the descending portion of the second extension arm. The liquid-absorbing surface is positionable about an outer surface of a glass balcony wall such that the inner edge contacts the glass balcony wall and the outer edge projects outwardly from the glass balcony wall to inhibit liquids used to clean the glass balcony wall from spilling below the level of the liquid-absorbing surface. In yet another related embodiment, the cart comprises means to raise and lower the first and second extension arms.

The invention also contemplates a method of maintaining an exterior surface of a building. An embodiment of this method comprises the steps of: positioning a cart proximate the exterior surface of a building in need of cleaning, the cart having a sufficient mass to counterweight a person suspended therefrom; unfolding an outrigger to stabilize the cart; securing the outrigger in an unfolded position; providing a jib having a harness point, the jib being attached to the cart; and attaching a line to the harness point; and attaching the line to a person to provide an anchor so that the person may lean over a balcony guardrail.

Additional advantages, aspects, and embodiments of the invention are described in the appended Drawings and Detailed Description of the Preferred Embodiments.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

In the Summary of the Invention above and in the Detailed Description of the Invention and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other ingredients, elements, steps, etc. are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

In this section, the present invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art.

Figure 1:
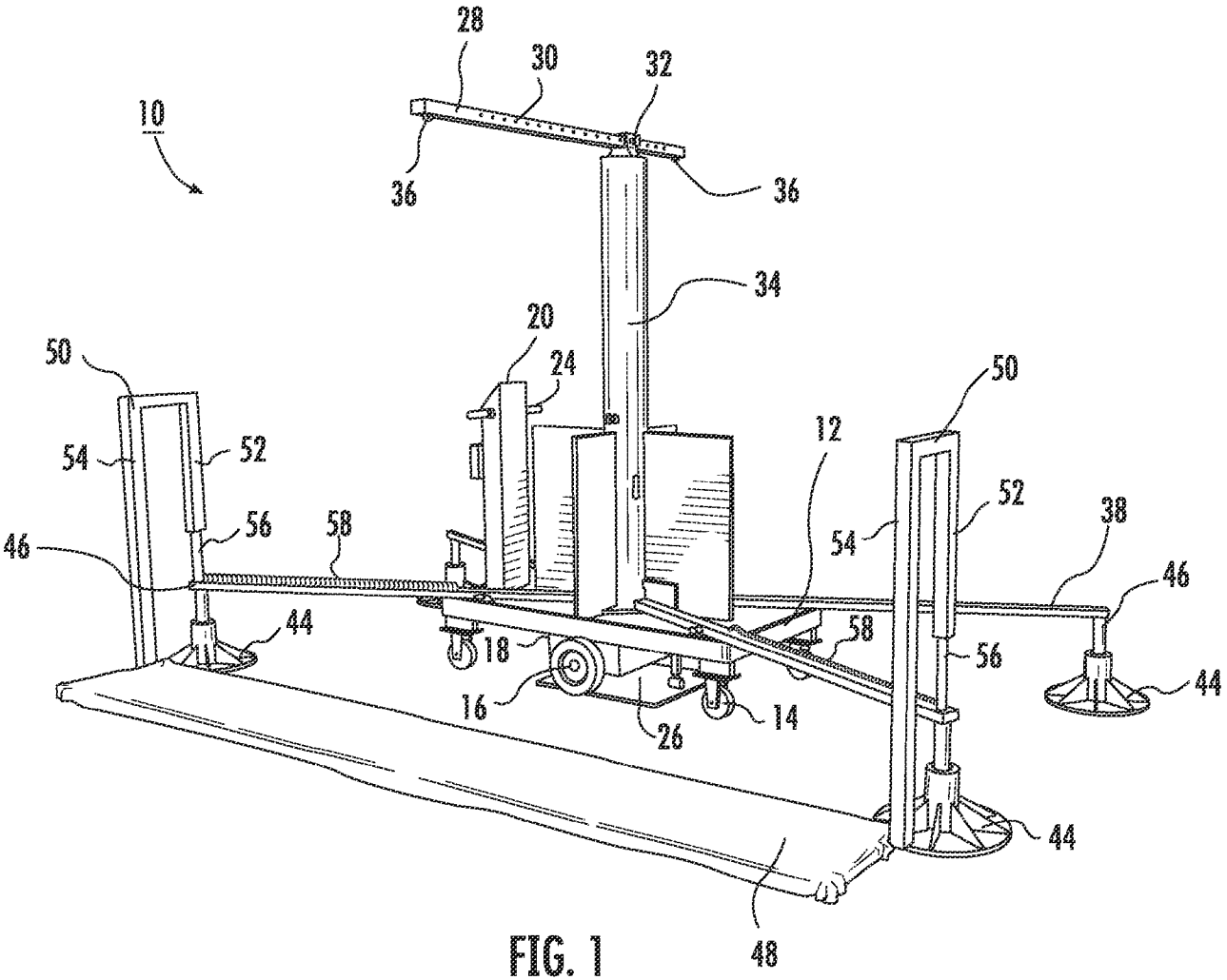
FIG. 1 illustrates an embodiment of a support structure.

Referring initially to FIG. 1, a portable folding support structure provides the requisite ballast and support to safely tether a worker so that he may safely lean over a balcony to clean glass or perform maintenance. A preferred embodiment of the support structure is a cart 10. The cart 10 has a base 12 that provides a platform to which wheels 14 are mounted. The base 12 is preferably rectangular or square, but can be any contemplated shape. The base 12 is a size that allows the cart 10 to fit through a residential doorway. The base 12 is preferably made of metal, such as steel for example, due to strength, the ability to weld other structures of the cart 10 to the base 12, and for added weight that provides the additional ballast for the support structure to optimally function. Other materials, such as wood, plastics, composites, and other engineered materials are also contemplated.

A drive wheel 16 is attached to propulsion means 18. The propulsion means 18 is preferably an electric motor, but an internal combustion engine is also contemplated. The electric motor is preferably powered by on-board batteries, but an external AC electricity source is also contemplated. In one especially preferred embodiment, external AC electricity is used to charge and recharge batteries that power the electric motor, yet the AC source also provides power to the motor when the cart 10 is plugged in to the AC source.

Figure 2:
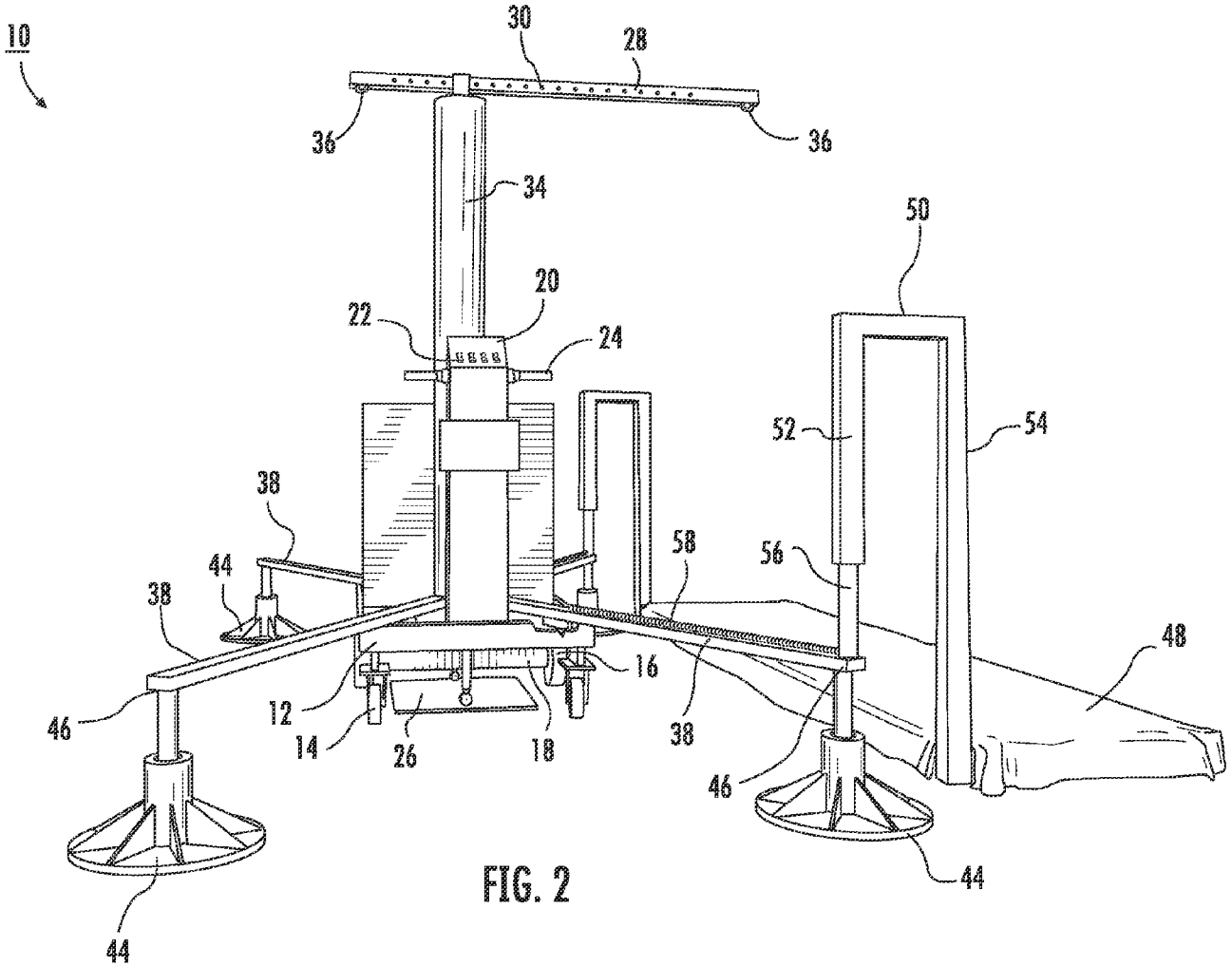
FIG. 2 is a side view of the support structure of FIG. 1.

As depicted in FIGS. 1 and 2, a control panel 20 provides an interface between a user and the cart 10. Controls 22 on the control panel 20 are used by the user to control the motion of the cart 10. In one embodiment, handlebars 24 are used to steer the cart 10, and also act as a turn throttle to control the speed of the motor. The controls 22 and handlebars 24 are preferably operated by a user's hands, and are thus situated at approximately hand level for a user of average height.

Figure 4:
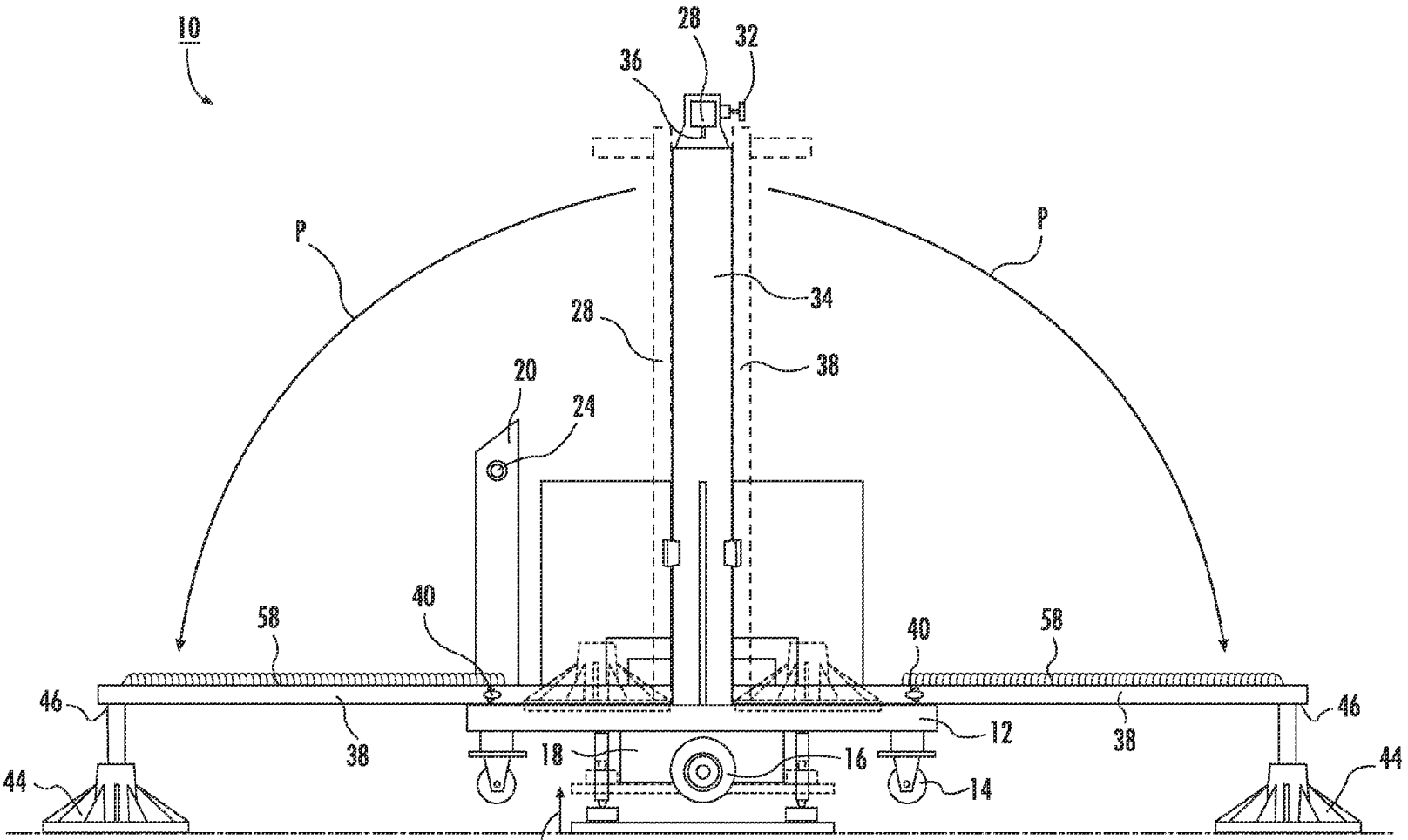
FIG. 4 illustrates the support structure of FIGS. 1-3, noting how the structure unfolds.

Turning again to FIG. 1, the cart 10 also has an anchoring plate 26 that is deployed below the cart. The anchoring plate 26 is an extendable brace that is lowered onto the floor below the cart 10 to lift the cart 10 sufficiently to prevent the cart 10 from rolling for the purpose of stabilization. The anchoring plate 26 remains in an unextended configuration when not in use. When a user desires to stabilize the cart 10, the user extends the anchoring plate 26 away from the cart 10 to contact the ground, and this is done through a mechanical linkage. In a preferred embodiment, the mechanical linkage is an automatic screw jack, scissor jack, or hydraulic jack positioned between the anchoring plate 26 and the base 12. The control panel 20 also has appropriate controls 22 to raise and lower the anchoring plate 26. For example, a screw jack has a motor that actuates a threaded rod integral to such a jack, and the motor is activated by related controls 22. Similarly, for example, a hydraulic pump is activated by the controls 22 to extend or retract a hydraulic jack connected to the anchoring plate 26. FIG. 4 illustrates a motion path (MP) the anchoring plate 26 travels to go from the extended to contracted position.

With continuing reference to FIGS. 1 and 2, a jib 28 extends from the cart 10. The jib 28 is a rigid member that is secured in a desired position with a mechanical securing device. In a preferred embodiment, holes 30 defined by the jib 28 receive a clevis pin 32 to secure the jib 28 in a configuration desired by the user. This provides the user with the ability to extend the jib 28 to protrude from the cart 10 a desired length. In one embodiment, the jib 28 is attached to a mast 34, and preferably at a joint that pivots, yet can be secured to prevent pivoting should a user desire. The jib 28 has a harness point 36 on its end for receiving a safety cable.

FIGS. 1 and 2 illustrate outriggers 38 that pivotingly extend away from the cart 10 to engage a surface upon which the cart 10 is situated. The outriggers 38 create a wide footprint and a more stable support structure for safely tethering a user. Between one and six outriggers 38 are used to provide stability with the preferred number of outriggers 38 being four.

Figure 3:
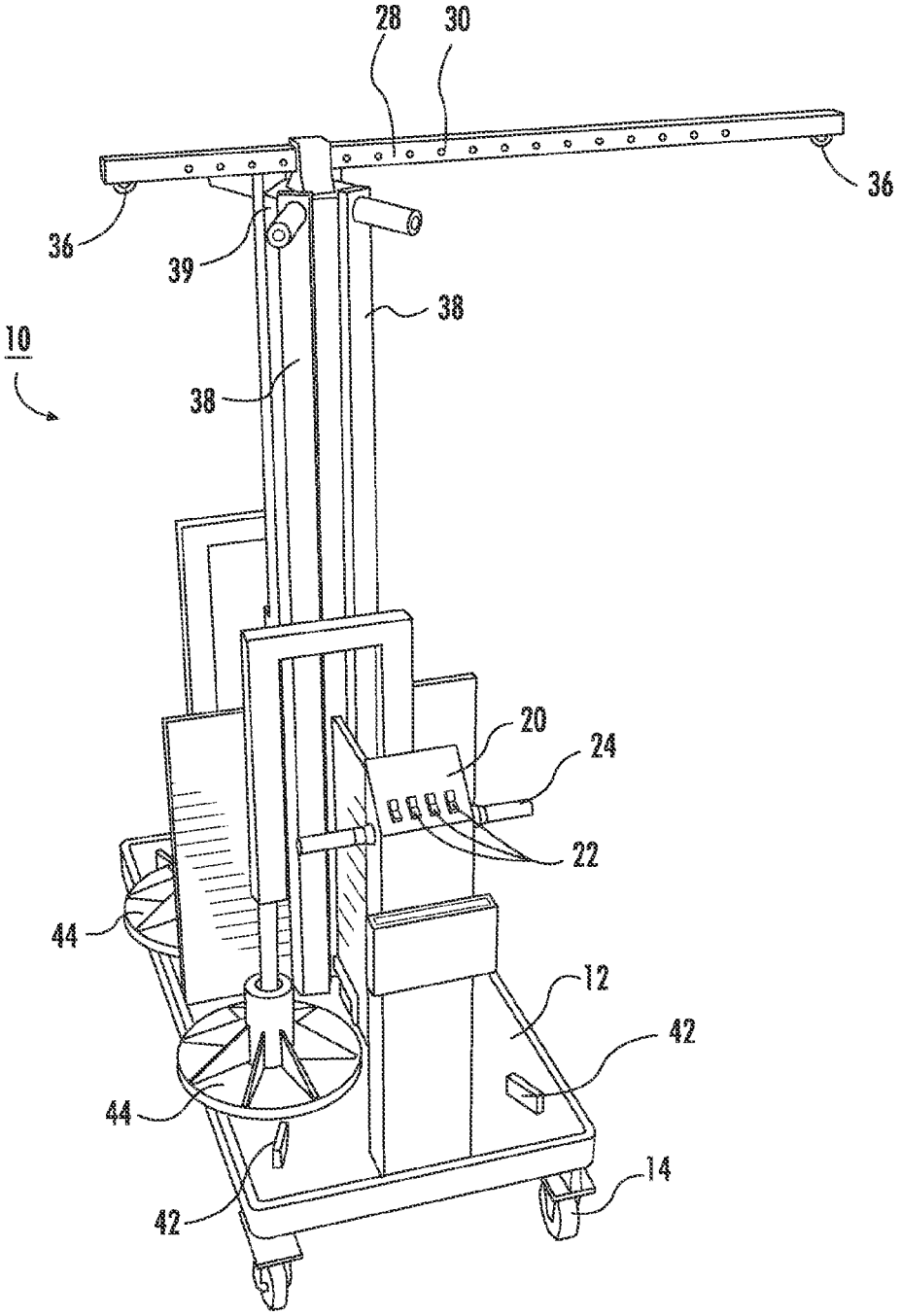
FIG. 3 illustrates the support structure of FIGS. 1-2 in a folded state.

FIG. 3 illustrates the outriggers 38 in a folded configuration. This is the configuration the cart 10 would take to navigate through doorways. FIG. 4 indicates the path (P) that the outriggers 38 take to go from the folded position to the extended position. Once in the extended position, the outrigger 38 is lockable in that position. In a preferred embodiment, the outrigger is locked with cotter pins 40 that engage both the outrigger 38 and a securing point 42 (FIG. 3) with the cart 10, however any conventional locking mechanism is contemplated.

FIGS. 1-4 illustrate anchoring pads 44 that attach to the outriggers 38. The anchoring pads 44 are removably attached a distal region 46 of the outriggers when in the extended position. The anchoring pads 44 provide a relatively large footprint for the cart 10 that results in greater stability. The anchoring pads 44 also provide additional ballast. The anchoring pads are made of a relatively heavy material such as metal, concrete, and combinations thereof. In FIG. 3, the anchoring pads 44 are placed upon the base 12 when not in use and the outriggers 38 are in the folded position.

Returning again to FIG. 1, the cart 10 also has, in one embodiment, a liquid-absorbing surface 48 for the purpose of catching drips and leftover cleaning fluids is provided. The liquid-absorbing surface 48 is made from acrylics, bamboo, cellulose materials, cotton, high density polyethylene, low density polyethylene, polyester, polyolefins, polyurethanes, polyurethane-polyurea copolymers, rayons, superabsorbent polymers, wools, and blends of these materials. For example, the liquid-absorbing surface 48 can be a textile surface such as industrial felt, and may be placed proximate an exterior side of a glass balcony during the cleaning process. As a user cleans the glass, excess water and cleaning solution runoff is caught by the liquid-absorbing surface 48 and therefore prevented from reaching surfaces on the units that are below the glass being cleaned.

In one embodiment, extension arms 50 are configured to secure the liquid-absorbing surface 48. In particular, each extension arm has an ascending portion 52 that attaches to an outrigger 38 and a descending portion 54 that attaches to the liquid-absorbing surface 48. The extension arm 50 is configured in approximately an upsidedown "U" shape so that the arm 50 can extend up and over a glass balcony while the descending portion 54 projects downward so that the liquid-absorbing surface 48 is placed below or near the bottom region of glass balcony surface being cleaned, the liquid-absorbing surface 48 being supported between two extension arms 50, and defining an outwardly projecting substantially horizontal surface.

In a related embodiment, the liquid-absorbing surface 48 is able to be mechanically raised and lowered about a balcony surface. The extension arms 50 ascending portions 52 are attached to extendable projections 56. The extendable projections 56 raise the extensions arms 50 so that the extension arms 50 clear the top edge of a glass balcony top, and then lower the extension arms over the glass balcony top. The extendable projections 56 are, for example without limitation, linear actuators, screw-type jacks, and hydraulic rams. The raising and lowering of the extension arms 50 is controlled by the controls 22 of the control panel 20. The controls 22 communicate with the extension arms 50 using connections 58 secured to the outriggers 38.

Figure 5:
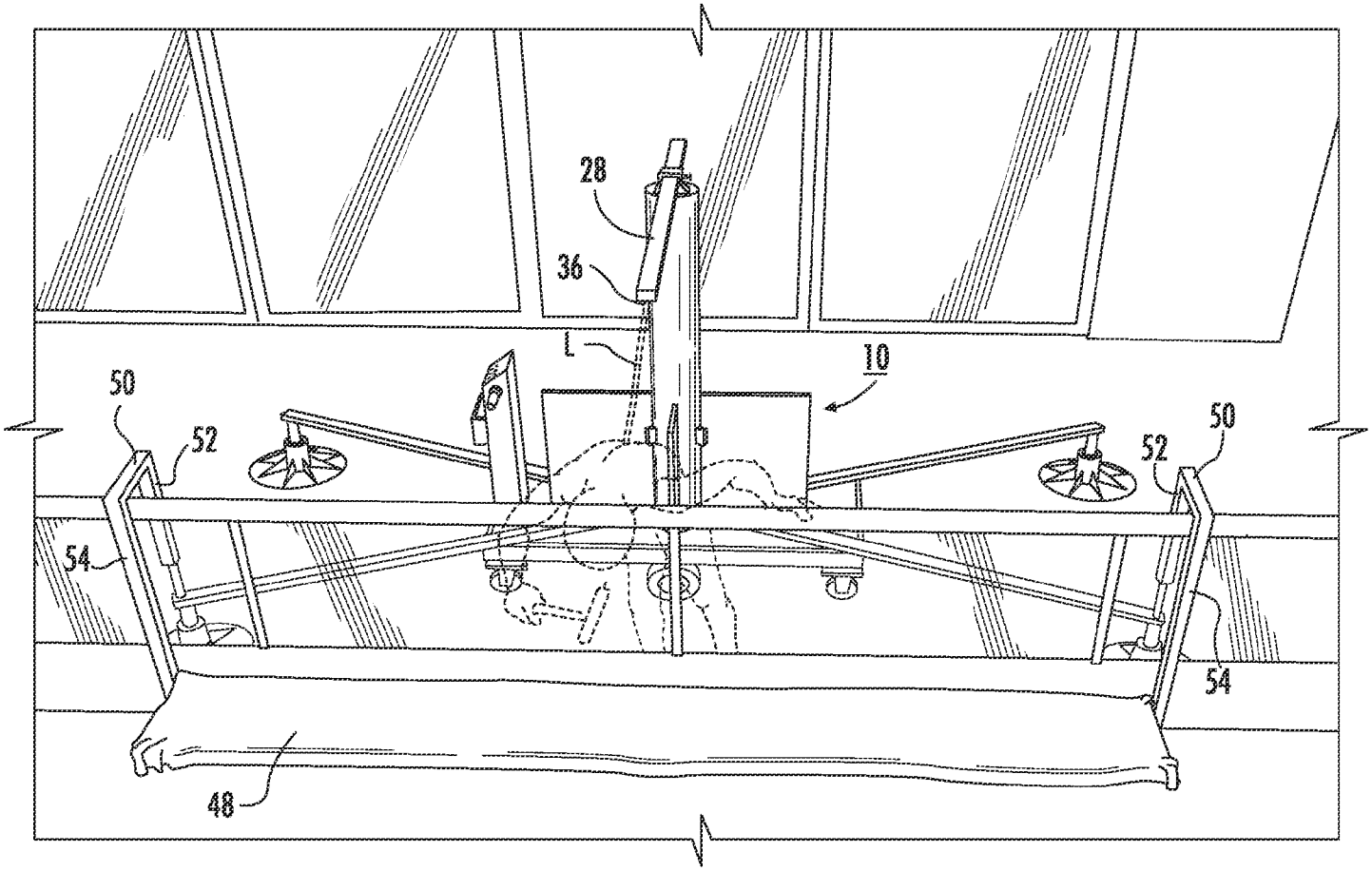
FIG. 5 illustrates the support structure of FIGS. 1-4 in a used state.

The invention also contemplates a method of maintaining an exterior building surface. FIG. 5 illustrates a person using the cart 10 as a secure point of tethering. The method includes positioning the cart 10 proximate and exterior surface in need of maintenance. In the illustration, the person is maintaining the structure by washing balcony glass. The cart 10 has a sufficient mass to act as a counterweight so that the person tethered to the cart 10 will be prevented from falling over the balcony. The outriggers 38 are unfolded to stabilize the cart. A line (L) is attached to a harness point 36 on the jib 28, and the person in need of an anchor attaches the line (L) to himself. A liquid-absorbing surface 48 may optionally be deployed, as described herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A portable support structure for safely tethering an individual, the portable support structure comprising:

a cart having a size and dimension to fit through a residential doorway;

a substantially vertical mast attached to the cart;

a jib pivotingly attached to the mast, the jib having a harness point capable of receiving a safety cable;

a first outrigger and a second outrigger projecting from the cart to provide stability to the cart;

an anchoring pad attached to a distal region of each of the first outrigger and the second outrigger;

a first extension arm connected to the first outrigger, the first extension arm having an ascending portion and a descending portion, wherein the first extension arm is lowerable about a glass balcony wall;

a second extension arm connected to the second outrigger, the second extension arm having an ascending portion and a descending portion, wherein the second extension arm is lowerable about the glass balcony wall; and a textile liquid absorbing surface having a first end, a second end, an inner edge and an outer edge, wherein the first end is attached to the first extension arm and the second end is attached to the second extension arm, wherein the textile liquid absorbing surface is positionable about an outer surface of the glass balcony wall and oriented such that the inner edge contacts the glass balcony wall and the outer edge projects outwardly from the glass balcony wall so that the textile liquid absorbing surface inhibits liquids used to clean the glass balcony wall from spilling below the glass balcony wall.

2. The portable folding support structure of claim 1 wherein the textile liquid absorbing surface is made of felt.

3. The folding support structure of claim 1, further comprising means to raise and lower the first and the second extension arms.

4. A method of maintaining an exterior building surface comprising the steps of:

positioning the portable support structure of claim 1 proximate to the exterior surface of a building, the cart having a sufficient mass to counterweight a person suspended therefrom;

attaching a line to the harness point; and attaching the line to a person to provide an anchor.

5. A method of maintaining the exterior building surface of claim 4 further comprising the steps of:

deploying the textile liquid-absorbing surface proximate to a bottom outside edge of the exterior surface of the building to absorb liquid cleaning product runoff.

* * * * *